US006000636A

United States Patent [19]

Huang

[11] Patent Number: 6,000,636

[45] Date of Patent: Dec. 14, 1999

[54] NOZZLE DEVICE

[76] Inventor: Yu-Chiung Huang, 58, Ma Yuan West St., Taichung, Taiwan

[21] Appl. No.: 09/162,900

[22] Filed: Sep. 29, 1998

[30] Foreign Application Priority Data

Oct. 7, 1997 [TW] Taiwan ..... 86217128

[51] Int. Cl.[6] ..... B05B 1/34; B05B 3/04

[52] U.S. Cl. ..... 239/381; 239/383; 239/464; 239/493

[58] Field of Search ..... 239/380, 381, 239/383, 382, 464, 493

[56] References Cited

U.S. PATENT DOCUMENTS 2,407,915 9/1946 Ball ..... 239/464

FOREIGN PATENT DOCUMENTS 27954 4/1964 Germany ..... 239/493

2069685 8/1981 United Kingdom ..... 239/493

*Primary Examiner*—Steven A. Bratlie

[57] ABSTRACT

A nozzle device has a hollow main body, a rotor, and a hollow nozzle cover. The hollow main body has an opening, a hollow chamber communicating with the opening, and a through hole communicating with the hollow chamber. The rotor has a taper first end and a plurality of guide recesses formed on a second end of the rotor. The hollow nozzle cover has a center aperture, a guide groove communicating with the center aperture, and an enlarged groove communicating with the guide groove. The rotor is inserted in the hollow chamber. The hollow nozzle cover is inserted in the opening.

1 Claim, 3 Drawing Sheets

NOZZLE DEVICE

BACKGROUND OF THE INVENTION

The present invention relates to a nozzle device. More particularly, the present invention relates to a nozzle device which can increase a rotation speed of a rotor.

A conventional nozzle device may produce instantaneous current in a certain direction. Therefore, a large amount of water will spray a certain area. Furthermore, the spray angle of the conventional nozzle device is very small. The sprayed water cannot cover a large area. In addition, the atomization effect of the sprayed water is poor.

SUMMARY OF THE INVENTION

An object of the present invention is to provide a nozzle device which can increase a rotation speed of a rotor.

Another object of the present invention is to provide a nozzle device which can improve the atomization effect of the sprayed water.

Another object of the present invention is to provide a nozzle device which can increase the spray angle of the nozzle device.

Another object of the present invention is to provide a nozzle device which can produce sprayed water to cover a large area.

Accordingly, a nozzle device comprises a hollow main body, a rotor, and a hollow nozzle cover. The hollow main body has an opening, a hollow chamber communicating with the opening, and a through hole communicating with the hollow chamber. The rotor has a taper first end and a plurality of guide recesses formed on a second end of the rotor. The hollow nozzle cover has a center aperture, a guide groove communicating with the center aperture, and an enlarged groove communicating with the guide groove. The rotor is inserted in the hollow chamber. The hollow nozzle cover is inserted in the opening. A high pressure water enters the through hole. The taper first end of the rotor forces the high pressure water to form a vortex current to push the rotor toward the hollow nozzle cover. The vortex current ejects from the center aperture via the hollow chamber, the guide recesses, the enlarged groove, and the guide groove. When the vortex current passes through the guide recesses, the rotor is inserted in the enlarged groove entirely.

DETAILED DESCRIPTION OF THE INVENTION

Figure 1:
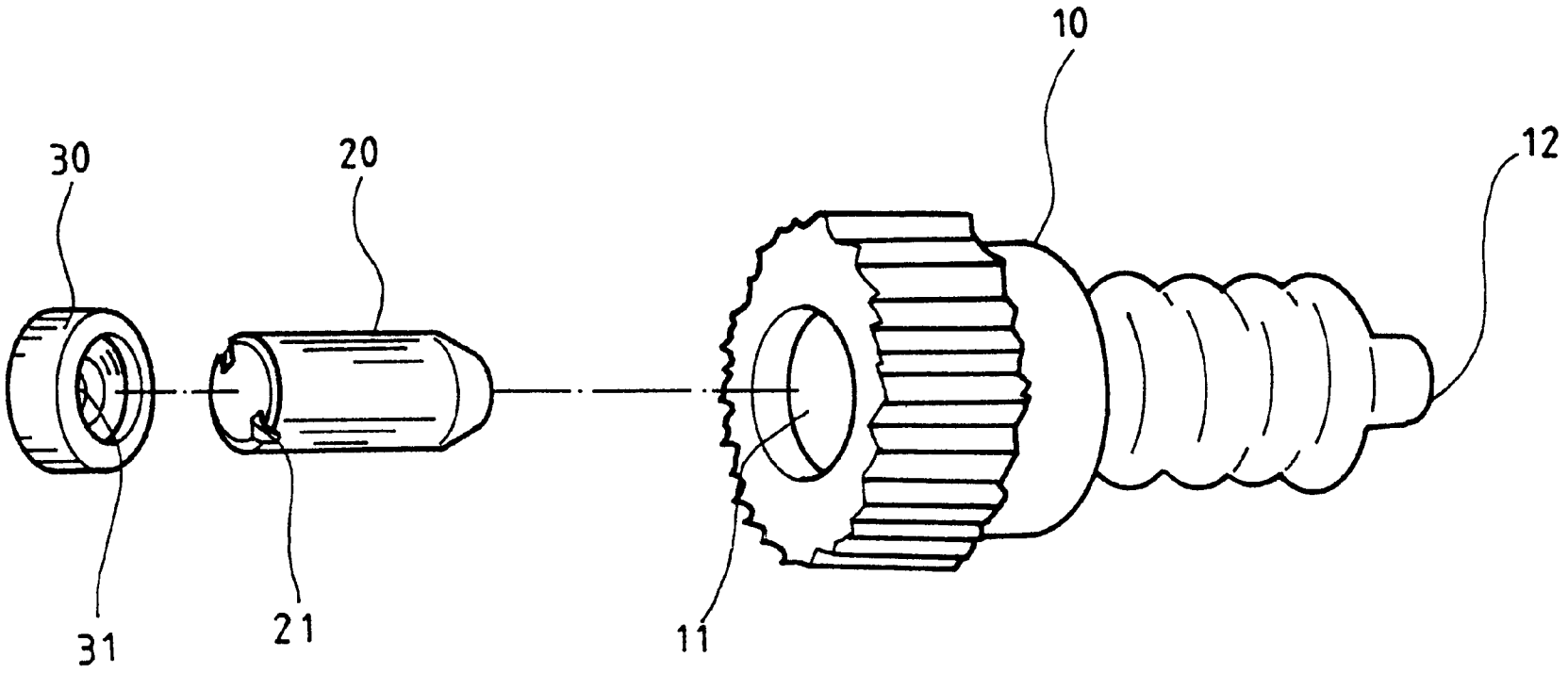
FIG. 1 is a perspective exploded view of a nozzle device of a preferred embodiment in accordance with the present invention.
Figure 2:
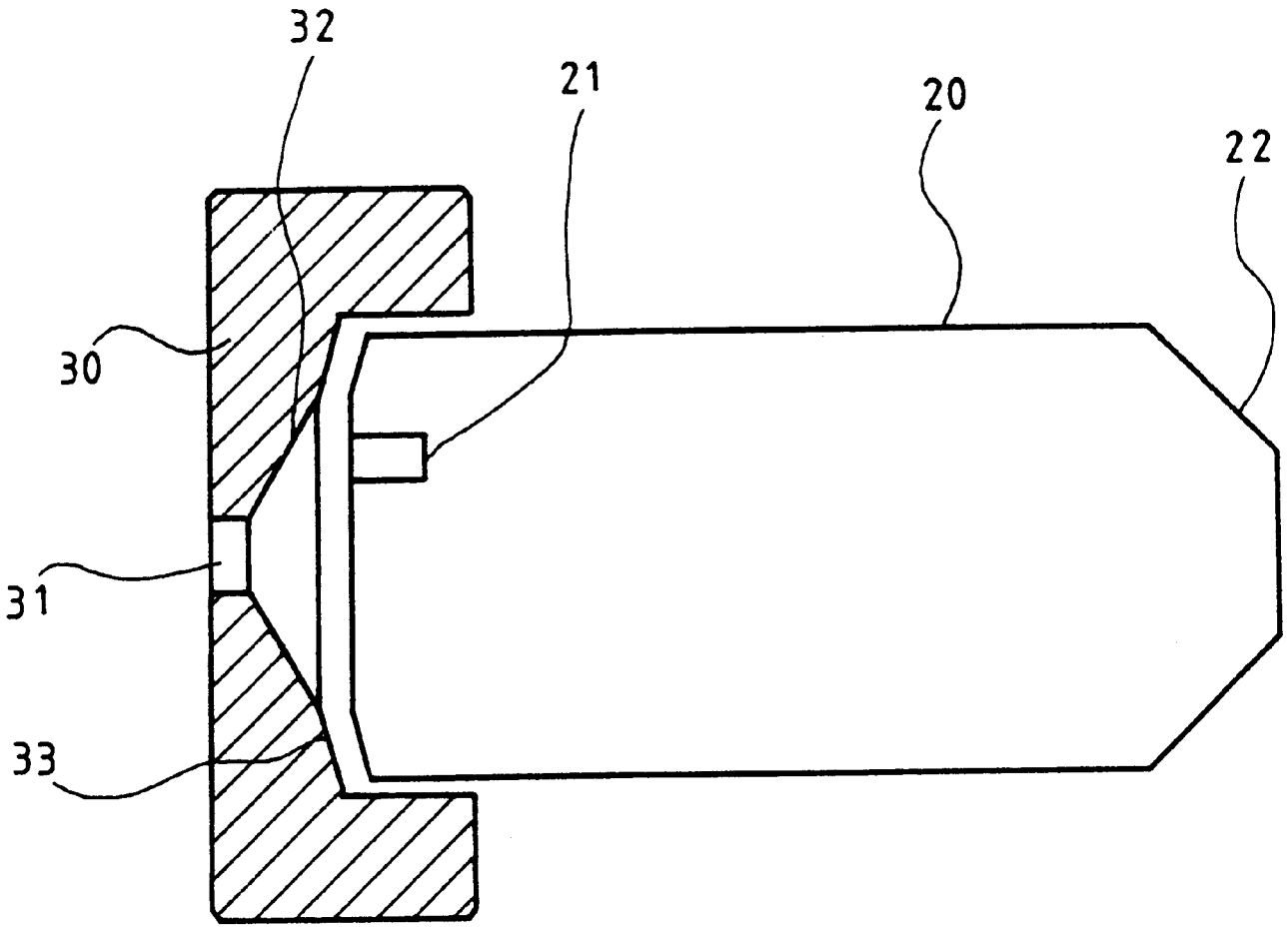
FIG. 2 is a sectional assembly view of a hollow cover and a rotor.
Figure 3:
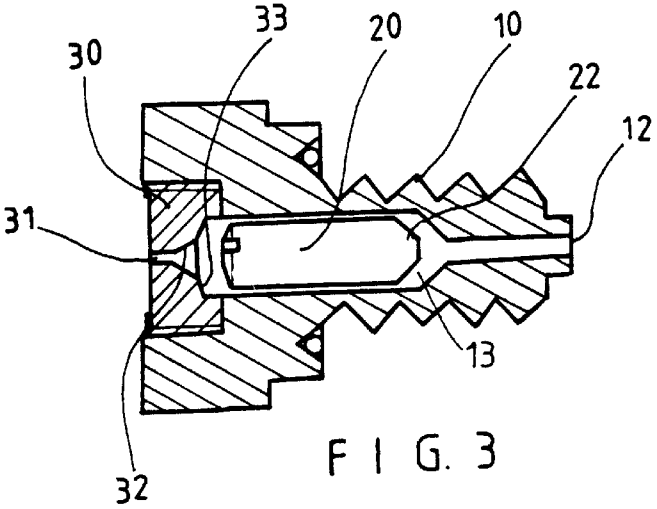
FIG. 3 is a sectional assembly view of a nozzle device of a preferred embodiment in accordance with the present invention.
Figure 4:
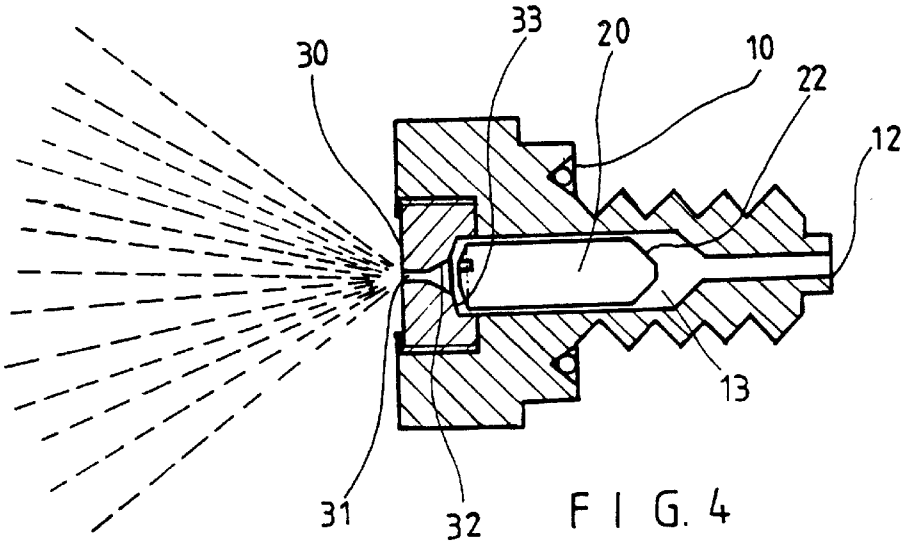
FIG. 4 is a schematic view illustrating an operation of a nozzle device of a preferred embodiment in accordance with the present invention.

Referring to FIGS. 1 to 4, a nozzle device comprises a hollow main body 10, a rotor 20, and a hollow nozzle cover 30.

The hollow main body 10 has an opening 11, a hollow chamber 13 communicating with the opening 11, and a through hole 12 communicating with the hollow chamber 13.

The rotor 20 has a taper first end 22 and a plurality of guide recesses 21 formed on a second end of the rotor 20.

The hollow nozzle cover 30 has a center aperture 31, a guide groove 32 communicating with the center aperture 31, and an enlarged groove 33 communicating with the guide groove 32.

The rotor 20 is inserted in the hollow chamber 13. The hollow nozzle cover 30 is inserted in the opening 11.

Referring to FIGS. 3 and 4 again, a high pressure water enters the through hole 12. The taper first end 22 of the rotor 20 forces the high pressure water to form a vortex current to push the rotor 20 toward the hollow nozzle cover 30. The vortex current ejects from the center aperture 31 via the hollow chamber 13, the guide recesses 21, the enlarged groove 33, and the guide groove 32. When the vortex current passes through the guide recesses 21, the second end of the rotor 20 is inserted in the enlarged groove 33 entirely.

The shape of the taper first end 22 of the rotor 20 allows the rotor 20 to rotate very fast to atomize the high pressure water into a vortex current to be ejected quickly.

The invention is not limited to the above embodiment but various modification thereof may be made. Further, various changes in form and detail may be made without departing from the scope of the invention.

I claim:

1. A nozzle device comprising:

a hollow main body, a rotor, and a hollow nozzle cover, the hollow main body having an opening, a hollow chamber communicating with the opening, and a through hole communicating with the hollow chamber, the rotor having a taper first end and a plurality of guide recesses formed on a second end of the rotor, the hollow nozzle cover having a center aperture, a guide groove communicating with the center aperture, and an enlarged groove communicating with the guide groove, the rotor inserted in the hollow chamber, the hollow nozzle cover is inserted in the opening, wherein a high pressure water enters the through hole, the taper first end of the rotor forces the high pressure water to form a vortex current to push the rotor toward the hollow nozzle cover, the vortex current ejects from the center aperture via the hollow chamber, the guide recesses, the enlarged groove, and the guide groove, and when the vortex current passes through the guide recesses, the second end of the rotor is inserted in the enlarged groove entirely.

* * * * *